United States Patent [19]

Masai

[11] 4,370,074

[45] Jan. 25, 1983

[54] FAN ASSEMBLY FOR VEHICLES

[75] Inventor: Hiroto Masai, Toyota City, Japan

[73] Assignee: Aisin Seiki Kabushiki Kaisha, Japan

[21] Appl. No.: 200,547

[22] Filed: Oct. 24, 1980

[30] Foreign Application Priority Data

Oct. 26, 1979 [JP] Japan ..... 54-149213[U]

[51] Int. Cl.[3] ..... B25G 3/36; E04G 7/00

[52] U.S. Cl. ..... 403/388; 403/220

[58] Field of Search ..... 403/39, 388, 365, 220

[56] References Cited

U.S. PATENT DOCUMENTS

| | | | |
|---|---|---|---|
| 2,527,787 | 10/1950 | Berger | 403/39 |
| 3,127,784 | 4/1964 | O'Neill | 403/388 X |
| 3,342,273 | 9/1967 | Crane | 403/379 X |
| 4,035,093 | 7/1977 | Redshaw | 403/388 X |

*Primary Examiner*—Wayne L. Shedd

*Attorney, Agent, or Firm*—Finnegan, Henderson, Farabow, Garrett & Dunner

[57] ABSTRACT

A fan assembly for vehicles, which includes a circular boss portion integrally provided with a plurality of inwardly-extending stress-distributing projections adapted to be connected to a viscous fluid coupling device by a plurality of plate springs, each plate spring being fixedly attached to its respective stress-distributing projection by a bushing. The stress-distributing projections are formed with sockets into which protrusions on the plate springs are fixedly received. The related sockets and protrusions serve to absorb vibrations in the fan assembly and forces caused by deformation of the plate spring, and thus keep the connection between the bushing and the stress-distributing projections from loosening.

5 Claims, 3 Drawing Figures

FAN ASSEMBLY FOR VEHICLES

BACKGROUND OF THE INVENTION

The present invention relates to a fan assembly, and more particularly to a fan assembly adapted for connection to a rotational member such as a fluid coupling associated with a drive shaft in an automobile.

One type of conventional fan assembly of the type to which the present invention relates includes a circular boss portion constructed of plastic and which has a plurality of inwardly-extending stress-distributing projections integrally formed thereon. The circular boss is connected to the rotational member by a plate spring which is fixed to the boss portion by bushings joining the plate spring to the stress-distributing projections.

One problem with this type of assembly, however, is that vibrations arising in the fan are not absorbed well. In addition, upon rotation of the fan assembly, forces caused by deformation of the plate spring act directly upon the bushings and the boss projections. In each case, the developed forces can cause the connection between the bushings and the projections to become loose.

SUMMARY OF THE INVENTION

It is, therefore, a main object of the present invention to provide a fan assembly which overcomes the above-mentioned drawbacks.

It is a more specific object of the present invention to provide an improved fan assembly adapted for connection to a rotatable member in an automotive vehicle, for example, a fluid coupling associated with a drive shaft in an automobile, which assembly absorbs vibrations and other forces arising in the fan assembly.

A still further object of this invention is to provide an improved fan assembly for automotive vehicles which is relatively simple and includes a minimum number of parts and yet is reliable in use.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the invention relates to a fan assembly of the type including a circular boss portion constructed of plastic and integrally formed with inwardly-extending stress-distributor means, connecting means for operatively connecting the boss portion to rotatable drive means, the connecting means including a plate spring fixedly attached to the stress-distributor means by bushing means; the improvement which comprises socket means formed in one of the stress-distributor means and plate spring, and protrusion means on the other of the projection means and plate spring and fixedly received in the socket means.

The foregoing and other objects, features, and advantages of the present invention will be made more apparent from the following description of the preferred embodiments. The accompany drawings, which are incorporated in and constitute a part of this specification, illustrate two preferred embodiments of the invention, and, together with the description, serve to explain the principles of the invention.

DESCRIPTION OF THE PREFERRED EMBODIMENTS

Reference will now be made in detail to the present preferred embodiments of the invention, two examples of which are illustrated in the accompanying drawings.

Figure 3:
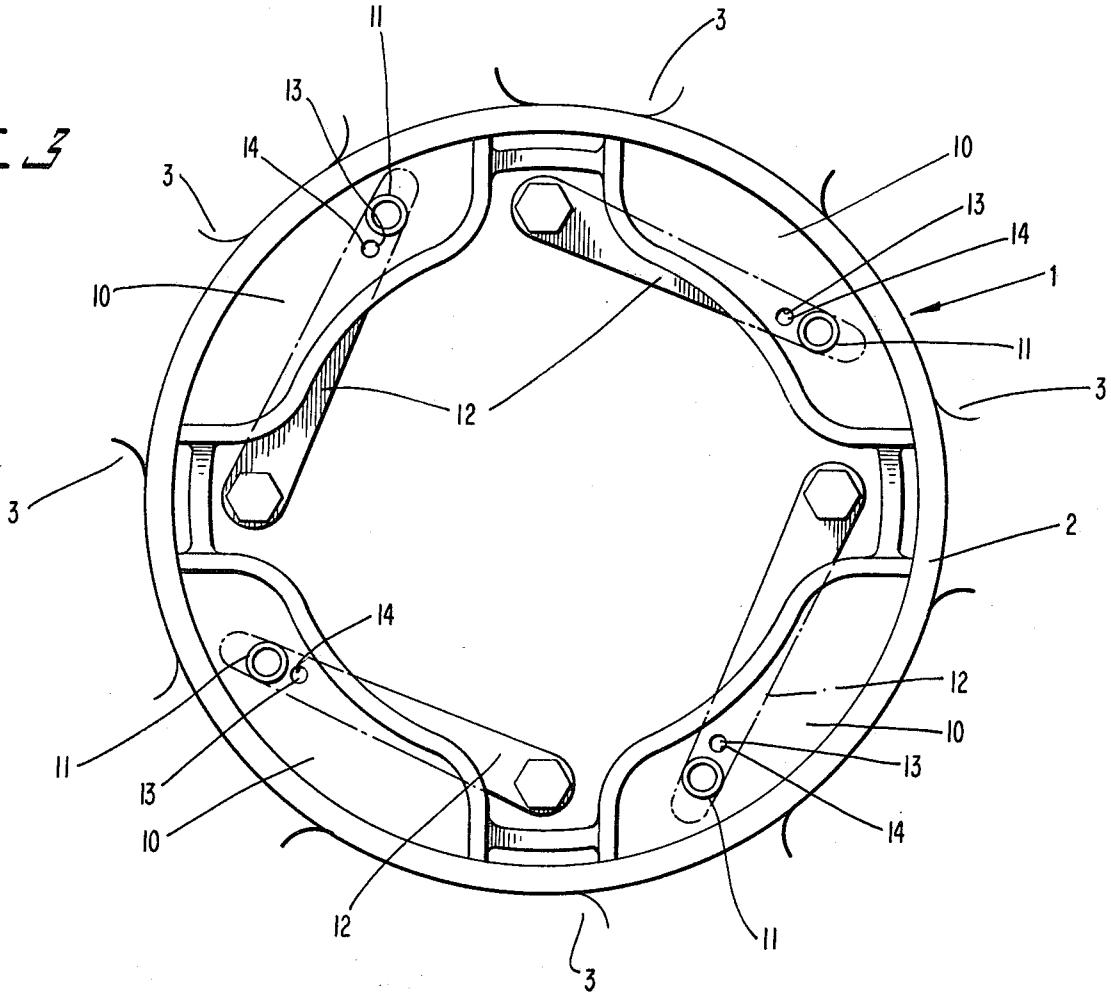
FIG. 3 is a front view of a portion of a fan assembly constructed in accordance with the present invention and adapted for connection to a rotary vehicle component such as a viscous fluid coupling.

FIG. 3 illustrates a fan assembly 1 of the type including a circular boss portion 2 constructed of plastic which is provided with a suitable number of flexible fan blades 3. The circular boss portion is integrally formed with inwardly-extending stress-distributor means. As embodied herein, the stress-distributor means includes a plurality of stress-distributor projections 10.

The fan assembly is adapted to be connected to a rotatable device means such as a fluid coupling device (not shown) associated with a drive shaft in an automobile by connecting means which, as embodied herein, is a plurality of plate springs 12. The connecting means is fixed to the stress-distributor means by bushing means. As embodied herein, each plate spring 12 is fixed to a stress-distributing projection 10 by a bushing 11. A plate spring 12 can be similarly fixed to each of the stress-distributing projections 10. Details of the circular boss portion and the rotary device means to which the fan assembly is adapted to be attached are known by and familiar to those skilled in the art. For example, reference may be made to the copending application of Kenichiro Mizutani, et al, Ser. No. 180,995, filed Aug. 25, 1980, entitled Fan Assembly For Vehicles, and owned by the assignee of this application.

In accordance with the invention, socket means are formed in one of the stress-distributor means and connecting means, and protrusion means on the other of the stress-distributor means and connecting means and fixedly received in the socket means.

Figure 1:
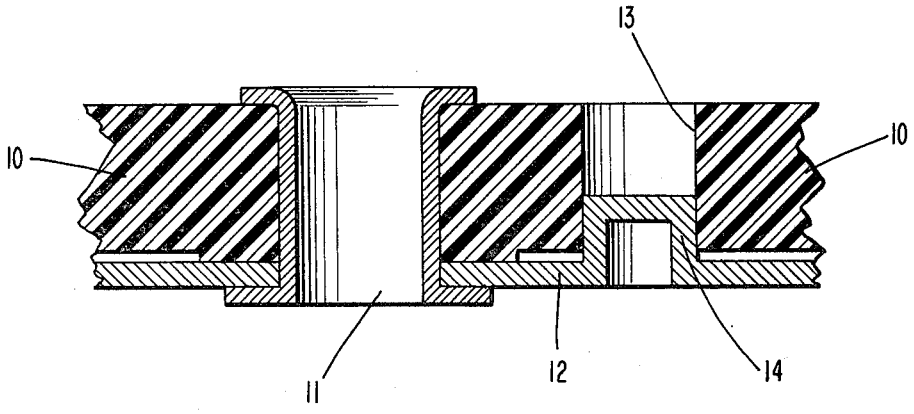
FIG. 1 is a sectional view through a portion of a fan assembly constructed in accordance with the present invention and which is adapted for connection to a rotary vehicle component such as a viscous fluid coupling.

FIG. 1 illustrates one embodiment of this invention. As embodied therein, the plate spring 12 is formed with a protrusion 14 which is fixedly received in a socket 13 in stress-distributor projection 10. The mating protrusion 14 and socket 13 are spaced from the bushing 11 and, because of the resilient or pliable nature of the plastic stress-distributing projection 10 forming the socket 13, serve to absorb vibrations arising in the fan assembly and any other forces which may be caused, for example, by deformation of the plate spring 12. Thus, if another rotating part which is fixed to the plate spring 12 is eccentric or canted relative to its axis of rotation, it can develop forces on the plate spring 12 which are absorbed by the resilient plastic material forming the socket 13 which receives the protrusion 14. If desired, a mating protrusion and socket may be provided at each of the stress-distributing projections 10 if a plurality thereof is provided.

Figure 2:
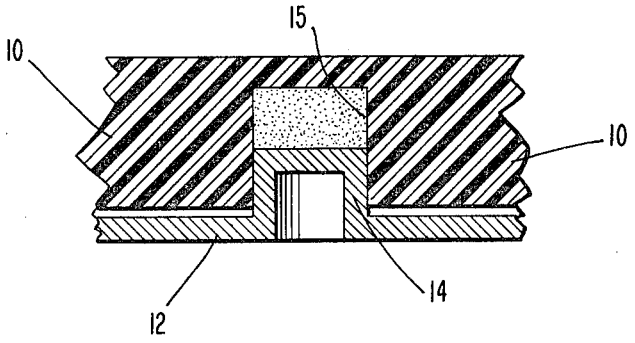
FIG. 2 is a view similar to FIG. 1 but showing a second embodiment of the invention.

FIG. 2 illustrates a modified form of this invention. As shown therein, the protrusion 14 on the plate spring 12 is fixedly received in a blind bore 15 which forms a socket. Before insertion of the protrusion 14, socket 15 is filled with oil or grease.

Although the present invention has been described by reference to two preferred embodiments thereof, it should be understood that various changes and modifications may be made without departing from the spirit and scope of the invention. For example, in FIGS. 1 and 2, the sockets 13, 15 are formed in the stress-distributing projection 10, and the protrusion 14 on the plate spring 12. It would, of course, be understood by one skilled in the art that this arrangement could be reversed, that is, the socket could be formed on the plate spring and the protrusion on the stress-distributing projection.

It is intended that the present invention cover such modifications and variations of this invention that come within the scope of the claims and their equivalents.

What is claimed is:

1. In a fan assembly of the type including a circular boss portion constructed of plastic and integrally formed with inwardly extending stress-distributor means, a connecting means for operatively connecting said boss portion to rotatable drive means, said connecting means including a plate spring fixedly attached to said stress-distributor means by bushing means; the improvement which comprises socket means including at least one socket formed in one of said stress-distributor means and plate spring, and protrusion means including at least one protrusion on the other of said stress-distrubutor means and plate spring and fixedly received in said socket means for the purpose of absorbing vibration.

2. The improvement as defined in claim 1 wherein said stress-distributor means includes a plurality of stress-distributing projections, said connecting means includes a plurality of plate springs, each of said stress-distributing projections is fixed to one of said plate springs by a bushing, and each of said stress-distributing projections is connected to one of said plate springs by a mating protrusion and socket.

3. The improvement as defined in claim 2 wherein said protrusions are formed on said plate springs, and said sockets are formed in said stress-distributing projections.

4. The improvement as claimed in claim 3 wherein said sockets are blind bores containing oil or grease.

5. The improvement as defined in claim 2 wherein said mating protrusions and sockets are spaced from said bushings.

* * * * *